US010696464B2

(12) United States Patent
Liao et al.

(10) Patent No.: US 10,696,464 B2
(45) Date of Patent: Jun. 30, 2020

(54) INFLATABLE PACKAGE WINE BAG

(71) Applicant: KUNSHAN AIRBAG PACKING CORP, Kunshan, Suzhou (CN)

(72) Inventors: Kao-Hsiung Liao, Kunshan (TW); Ping-Yuan Liao, Kunshan (CN)

(73) Assignee: KUNSHAN AIRBAG PACKING CORP, Kunshan (CN)

( * ) Notice: Subject to any disclaimer, the term of this patent is extended or adjusted under 35 U.S.C. 154(b) by 0 days.

(21) Appl. No.: 16/536,362

(22) Filed: Aug. 9, 2019

(65) Prior Publication Data

US 2020/0047969 A1 Feb. 13, 2020

(30) Foreign Application Priority Data

Aug. 13, 2018 (TW) ..... 107128235 A

(51) Int. Cl.
*B65D 81/05* (2006.01)
*B65D 85/30* (2006.01)

(52) U.S. Cl.
CPC ..... *B65D 81/052* (2013.01); *B65D 85/30* (2013.01)

(58) Field of Classification Search
USPC ..... 206/522, 521, 485
See application file for complete search history.

(56) References Cited

U.S. PATENT DOCUMENTS 8,251,216 B1 * 8/2012 Liao ..... B65D 81/052 206/522
2003/0024846 A1 * 2/2003 Nadler ..... B65D 81/03 206/522
2008/0116101 A1 * 5/2008 Snyder ..... B65D 81/03 206/522
2009/0169134 A1 * 7/2009 Hsu ..... B65D 81/03 383/3
2011/0233101 A1 9/2011 Baines
2012/0000807 A1 * 1/2012 Scarbrough ..... B65D 81/02 206/522
2016/0058218 A1 * 3/2016 Yoshifusa ..... A47C 27/081 428/12
2020/0024049 A1 * 1/2020 Borrero ..... B65B 31/04
2020/0031085 A1 * 1/2020 Baines ..... B65D 81/052

OTHER PUBLICATIONS

Taiwan Patent Office, Office Action, Patent Application Serial No. TW107128235, dated Nov. 23, 2018.

* cited by examiner

*Primary Examiner* — Jacob K Ackun
(74) *Attorney, Agent, or Firm* — Rabin & Berdo, P.C.

(57) ABSTRACT

An inflatable package wine bag includes a bottom wall, a first fixing structure, and a second fixing structure. The first fixing structure includes a first connecting portion and a first bending portion. The second fixing structure includes a second connecting portion and a second bending portion. The first bending portion includes a first inner side surface wall and a first opening, and the second bending portion includes a second inner side surface wall and a second opening.

10 Claims, 7 Drawing Sheets

INFLATABLE PACKAGE WINE BAG

CROSS-REFERENCE TO RELATED APPLICATION

This non-provisional application claims priority under 35 U.S.C. § 119(a) to Patent Application No. 107128235 filed in Taiwan, R.O.C. on Aug. 13, 2018, the entire contents of which are hereby incorporated by reference.

BACKGROUND

Technical Field

The present invention relates to a package wine bag, and in particular, to the one made of an inflatable package material, is suitable for fixing and protecting a bag similar to a wine bottle.

Related Art

With the advancement of society and the rapid development of logistics, in order to protect the transported goods from external damage, various packaging materials have been proposed.

Long-shaped conveying goods such as wine bottles are conventionally protected by thick cardboard concave folds, or protected by paper plastic packaging materials, and also use Styrofoam as a protective material.

However, no matter what kind of packaging material is used, some packaging materials are not strong enough to protect. Once there is a gap, the whole protective material will tear along the gap, such as cardboard. Some packaging materials have relatively high manufacturing costs, and are also prone to environmental damage and difficult to recycle, such as paper plastic or Styrofoam.

SUMMARY

The present invention relates to an inflatable package wine bag, which is suitable for packaging and fixing bottles. A packaging base is formed by a plurality of air columns, each of which includes heat sealing lines on two sides of an extending direction. The inflatable package wine bag further includes a bottom wall, a first fixing structure, and a second fixing structure.

The first fixing structure includes a first connecting portion and a first bending portion. One end of the first connecting portion is connected to a top end of the bottom wall.

A first heat sealing pitch line is disposed at a joint between the first connecting portion and the bottom wall. The other end of the first connecting portion is connected to a first connecting end of the first bending portion, and a first extending end opposite to the first connecting end in the first bending portion is adhered to an upper surface of the bottom wall. A plurality of first heat sealing contacts is disposed on the heat sealing lines on the first extending end, and is adhered to the heat sealing lines relatively adjacent to the top end. The first bending portion includes a first inner side surface wall and a first opening, which is disposed on the first inner side surface wall and can cover the upper part of the bottle.

The second fixing structure includes a second connecting portion and a second bending portion. One end of the second connecting portion is connected to a bottom end of a bottom wall. A second heat sealing pitch line is disposed at a joint between a second connecting portion and the bottom wall. The other end of the connecting portion is connected to a second connecting end of the second bending portion, and a second extending end opposite to the second connecting end in the first bending portion is adhered to an upper surface of the bottom wall. A plurality of second heat sealing points is disposed on the heat sealing lines on the second extending end, and is adhered to the heat sealing lines relatively adjacent to the bottom. The second bending portion includes a second inner side surface wall and a second opening, which is disposed on the second inner side surface wall and can cover the bottom part of the bottle.

According to the inflatable package wine bag described above, in an embodiment, the first connecting portion is the first outer side surface wall. The first bending portion further includes a first connecting surface wall, and the first connecting surface wall is connected to the first outer side surface wall and the first inner side surface wall. The first inner side surface wall is adhered to the bottom wall.

According to the inflatable package wine bag described above, in an embodiment, a first outer side heat sealing pitch line is disposed at a joint between the first connecting surface wall and the first outer side surface wall and a first inner side heat sealing pitch line is disposed at a joint between the first connecting surface wall and the first inner side surface wall.

According to the inflatable package wine bag described above, in an embodiment, a plane of the first inner side surface wall forms a first acute angle with a plane of the bottom wall.

According to the inflatable package wine bag described above, in an embodiment, a plane of the first inner side surface wall is perpendicular to a plane of the bottom wall.

According to the inflatable package wine bag described above, in an embodiment, the second connecting portion is the second outer side surface wall. The second bending portion further includes a second connecting surface wall, the second connecting surface wall is connected to the first outer side surface wall and the second inner side surface wall, and the second inner side surface wall is adhered to the bottom wall.

According to the inflatable package wine bag described above, a second outer side heat sealing pitch line is disposed at a joint between the second connecting surface wall and the second outer side surface wall and a second inner side heat sealing pitch line is disposed at a joint between the second connecting surface wall and the second inner side surface wall.

According to the inflatable package wine bag described above, in an embodiment, a plane of the second inner side surface wall forms a second acute angle with a plane of the bottom wall.

According to the inflatable package wine bag described above, in an embodiment, a plane of the second inner side surface wall is perpendicular to a plane of the bottom wall.

According to the inflatable package wine bag described above, in an embodiment, further includes a protective surface wall, located on one side of the bottom wall and connected to the first fixing structure and the second fixing structure.

The inflatable package wine bag disclosed by a plurality of or one embodiment of the invention has low manufacturing cost, high protection strength, and high stability, which is sufficient to ensure the safety of conveying goods. In addition, in an embodiment, the inflatable package wine bag may be used not only for carton and container transportation, but also as a display base for collecting and transporting goods. That is, the inflatable packaging wine bag disclosed by a plurality of or one embodiment of the present invention may solve the problems encountered by previous technologies.

DETAILED DESCRIPTION

Figure 1:
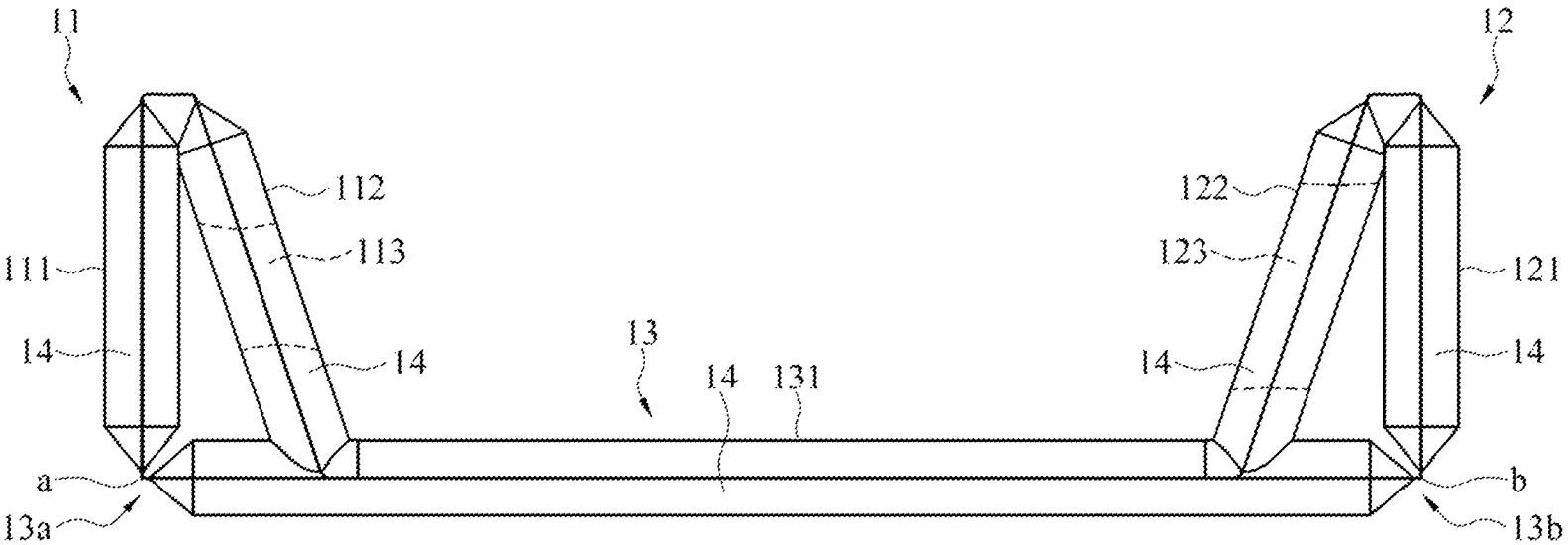
FIG. 1 is a schematic side view of an inflatable package wine bag according to a first embodiment of the present invention.

FIG. 1 is a schematic side view of an inflatable package wine bag 1 according to a first embodiment of the present invention. The inflatable package wine bag 1 is suitable for packaging and fixing a bottle 2. A packaging base is formed by a plurality of air columns 14, each of which includes a heat sealing line L on two sides of an extending direction. The inflatable package wine bag 1 further includes a bottom wall 13, a first fixing structure 11, and a second fixing structure 12.

The first fixing structure 11 includes a first connecting portion 111 and a first bending portion 112. One end of the first connecting portion 111 is connected to a top end 13*a* of the bottom wall 13. A first heat sealing pitch line a is disposed at a joint between the first connecting portion 111 and the bottom wall 13. The other end of the first connecting portion 111 is connected to a first connecting end 112*a* of the first bending portion 112, and a first extending end 112*b* opposite to the first connecting end 112*a* in the first bending portion 112 is adhered to an upper surface 131 of the bottom wall 13. A plurality of first heat sealing points 112*c* is disposed on the heat sealing line L on the first extending end 112*b*, which is adhered to the heat sealing line L relatively adjacent to the top end 13*a*. The first bending portion 112 further includes a first opening 113, which can cover the upper part of the bottle 2.

The second fixing structure 12 includes a second connecting portion 121 and a second bending portion 122. One end of the second connecting portion 121 is connected to a bottom end 13*b* of the bottom wall 13. A second heat sealing pitch line b is disposed at a joint between the second connecting portion 121 and the bottom wall 13. The other end of the second connecting portion 121 is connected to the second connecting end 122*a* of the second bending portion 122, and the second bending portion 122 is adhered to the upper surface 131 of the bottom wall 13 with respect to the second extending end 122*b* of the second connecting end 122*a*. A plurality of second heat sealing contacts (not shown in the diagram) is disposed on the heat sealing line L on the second extending end 122*b*, and is adhered to the heat sealing line L relatively adjacent to the bottom 13*b*. The second bending portion 122 further includes a second opening 123, which can cover the bottom part of the bottle 2.

Figure 2:
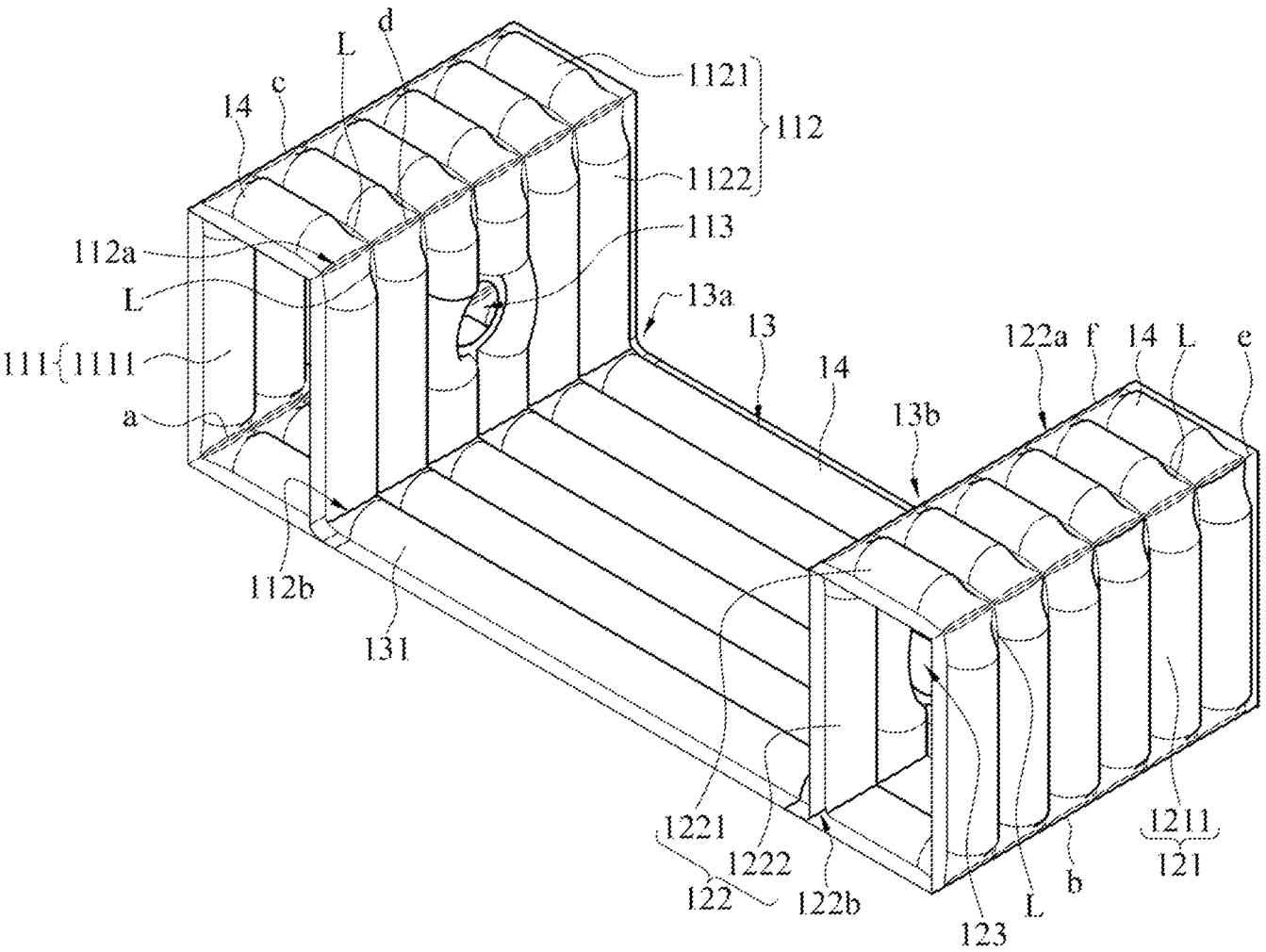
FIG. 2 is a schematic appearance diagram of an inflatable package wine bag according to a second embodiment of the present invention.
Figure 3:
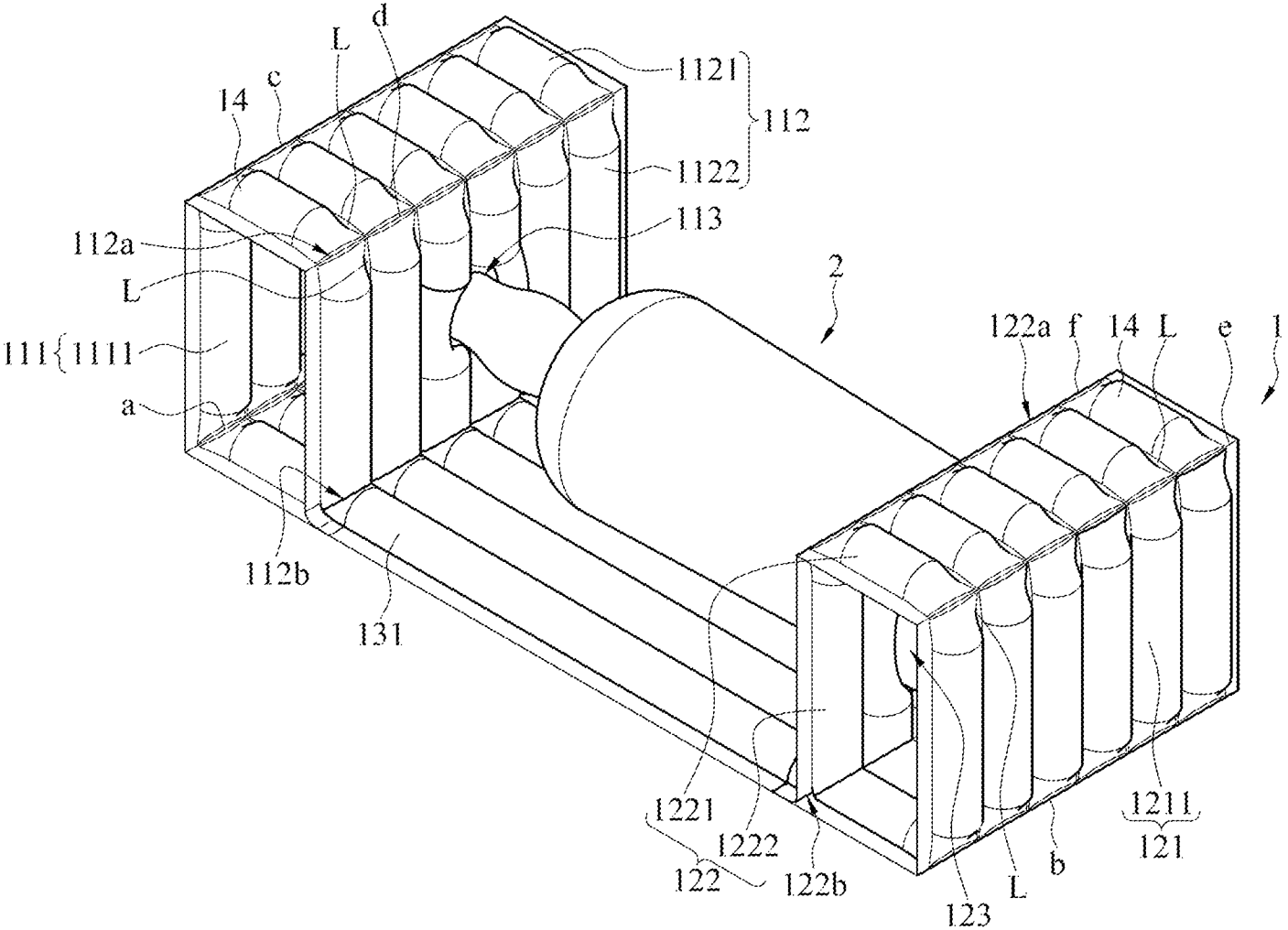
FIG. 3 is a schematic usage state diagram of an inflatable package wine bag according to a second embodiment of the present invention.
Figure 4:
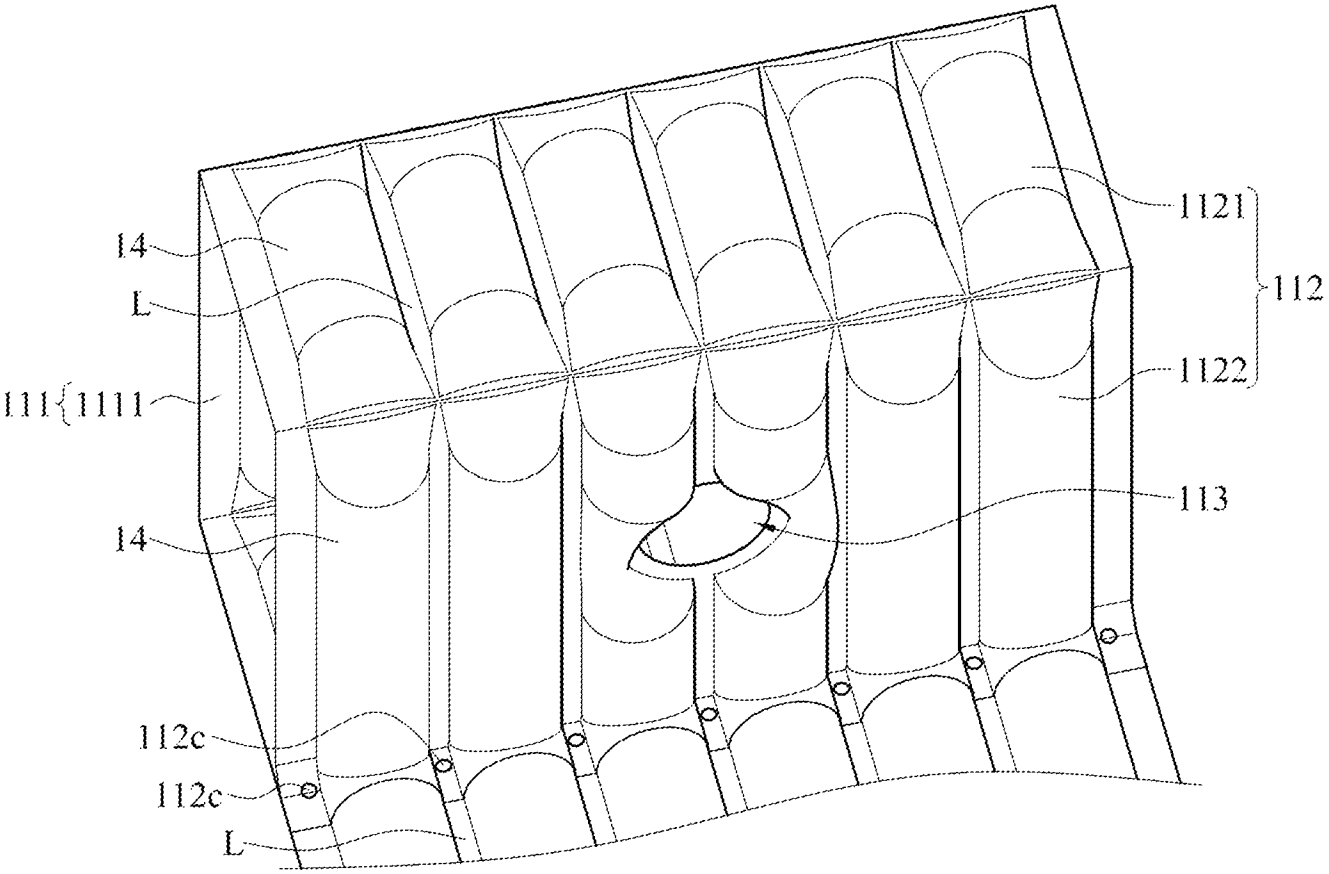
FIG. 4 is a schematic partial appearance diagram of an inflatable package wine bag according to a second embodiment of the present invention.

Referring to FIG. 2 to FIG. 4, FIG. 2 is a schematic appearance diagram of an inflatable package wine bag 1 according to a second embodiment of the present invention. FIG. 3 is a schematic usage state diagram of the inflatable package wine bag 1 according to the second embodiment of the present invention. FIG. 4 is a schematic partial appearance diagram of the inflatable package wine bag 1 according to the second embodiment of the present invention.

In this embodiment, a first connecting portion 111 includes a first outer side surface wall 1111, and a first bending portion 112 includes a first connecting surface wall 1121 and a first inner side surface wall 1122. The first connecting surface wall 1121 is connected to the first outer side surface wall 1111 and the first inner side surface wall 1122. The first inner side surface wall 1122 is adhered to a bottom wall 13, and a first opening 113 is disposed on the first inner side surface wall 1122. Similarly, in this embodiment, a second connecting portion 121 includes a second outer side surface wall 1211. A second bending portion 122 includes a second connecting surface wall 1221 and a second inner side surface wall 1222. The second connecting surface wall 1221 is connected to the second outer side surface wall 1211 and the second inner side surface wall 1222. The second inner side surface wall 1222 is adhered to the bottom wall 13. A second opening 123 is disposed on the second inner side surface wall 1222.

In addition, a first outer side heat sealing pitch line c is disposed at a joint between the first connecting surface wall 1121 and the first outer side surface wall 1111 and a first inner side heat sealing pitch line d is disposed at a joint between the first connecting surface wall 1121 and the first inner side surface wall 1122. Similarly, in this embodiment, a second outer side heat sealing pitch line e is disposed at a joint between the second connecting surface wall 1221 and the second outer side surface wall 1211 and a second inner side heat sealing pitch line f is disposed at a joint between the second connecting surface wall 1221 and the second inner side surface wall 1222. In this way, it is convenient for users or operators to bend the packaging material to pack the bottle 2, and has the effect of cushioning external forces.

As shown in FIG. 4, take the first bending portion 112 as an example. Compared with the first outer side heat sealing line c and the first inner side heat sealing line e, a method in which the first bending portion 112 is adhered to the upper surface 131 of the bottom wall 13 by the first heat sealing point 112*c*. The method has advantages of high stability, high strength, and difficulty in folding, and can be stabilized to protect the bottle 2. Similarly, for the second bending portion 122, the method in which the second bending portion 122 is adhered to the upper surface 131 of the bottom wall 13 by the second heat sealing point has the same advantages.

Figure 5:
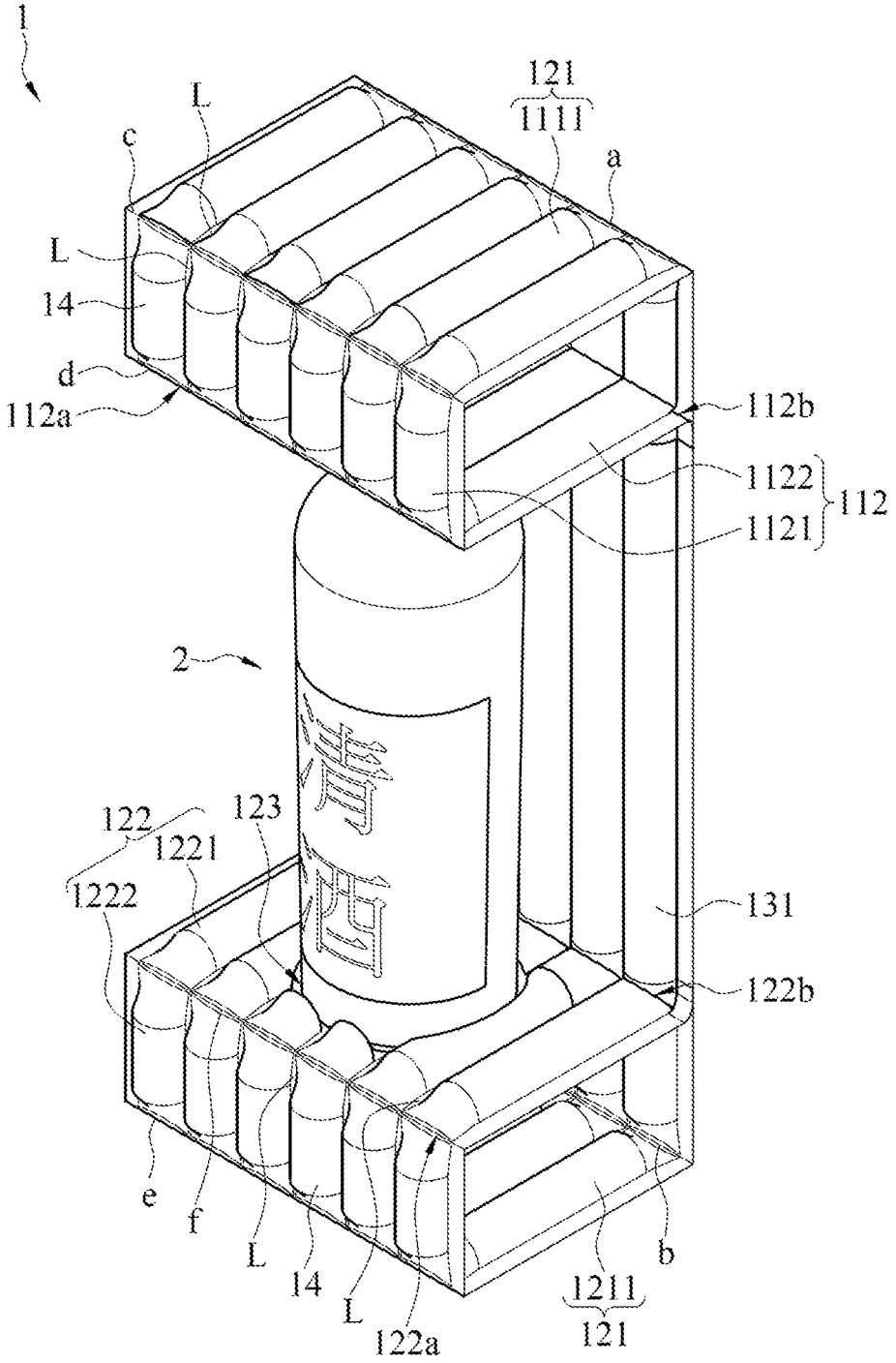
FIG. 5 is another schematic usage state diagram of an inflatable package wine bag according to a second embodiment of the present invention.

FIG. 5 is another schematic usage state diagram of an inflatable package wine bag 1 according to the second embodiment of the present invention. In this embodiment, in addition to be used for a transport protection, the inflatable package wine bag 1 may also be used as a fixed seat. For users or manufacturers who have a hobby for collecting, the inflatable packaged wine bag 1 may be used to store a bottle 2 in a cabinet or a display shelf, and in addition to a fixed protection function, the appearance cannot be hindered.

Especially for some manufacturers of the bottle 2, it is particularly important to be capable of displaying a trademark on the bottle 2.

Figure 6:
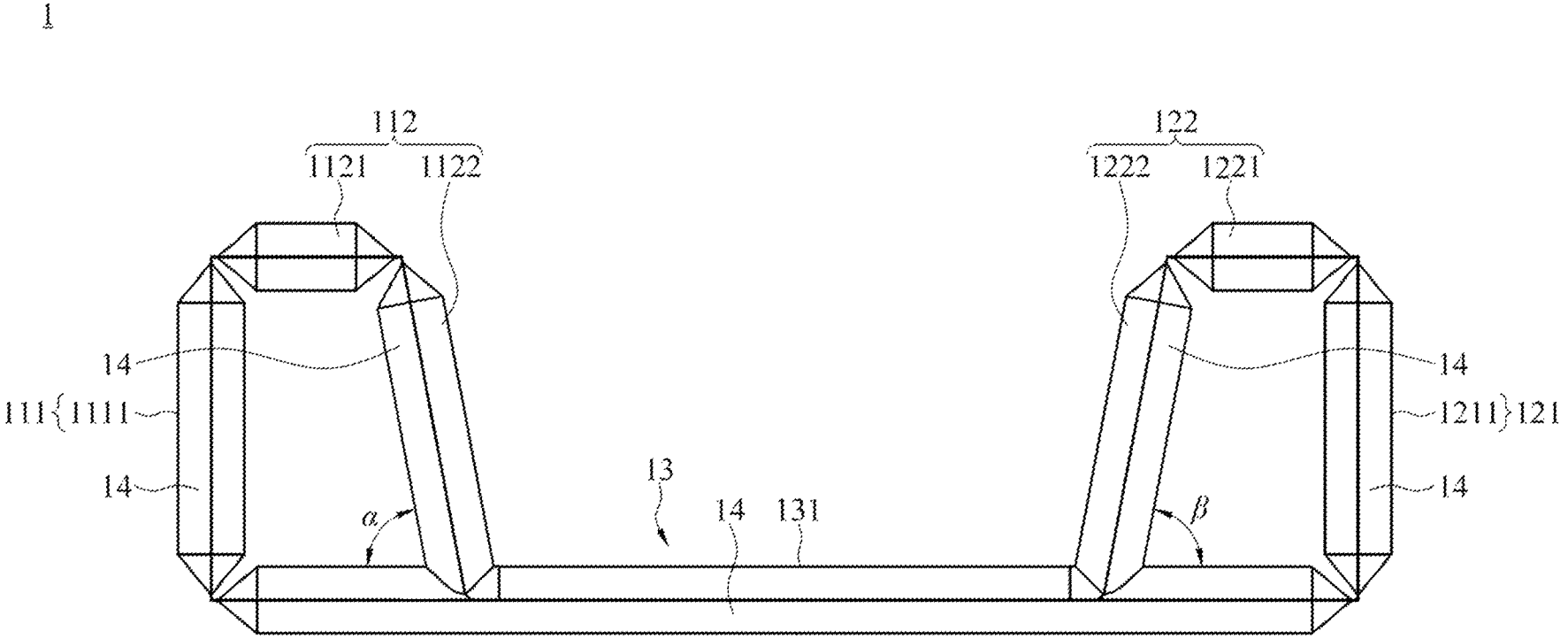
FIG. 6 is a schematic side view of an inflatable package wine bag according to a third embodiment of the present invention.

FIG. 6 is a schematic side view of an inflatable package wine bag 1 according to a third embodiment of the present invention. In this embodiment, a plane of a first inner side surface wall 1122 forms a first acute angle α with a plane of the bottom wall 13; similarly, a plane of a second inner side surface wall 1222 forms a second acute angle β with a plane of the bottom wall 13. The first acute angle α and the second acute angle β are less than 90 degrees.

However, in some embodiments, the plane of the first inner side surface wall 1122 is perpendicular to the plane of the bottom wall 13; the plane of the second inner side surface wall 1222 is perpendicular to the plane of the bottom wall 13.

As the foregoing descriptions, a first bending portion 112 and a second bending portion 122 are adhered to the surface of the bottom wall 13 with a first heat sealing point 112*c* and a second heat sealing point in the heat sealing line L. High fixation and high strength are included to fix and protect the bottle 2. The invention does not limit the angle between the first inner side surface wall 1122, the second inner side surface wall 1222, and the bottom wall 13, which depends on the needs of users or businesses. For example, in an embodiment, the first inner side surface wall 1122 forms the first acute angle α with the bottom wall 13, and the second inner side surface wall is perpendicular to the bottom wall 13.

Figure 7:
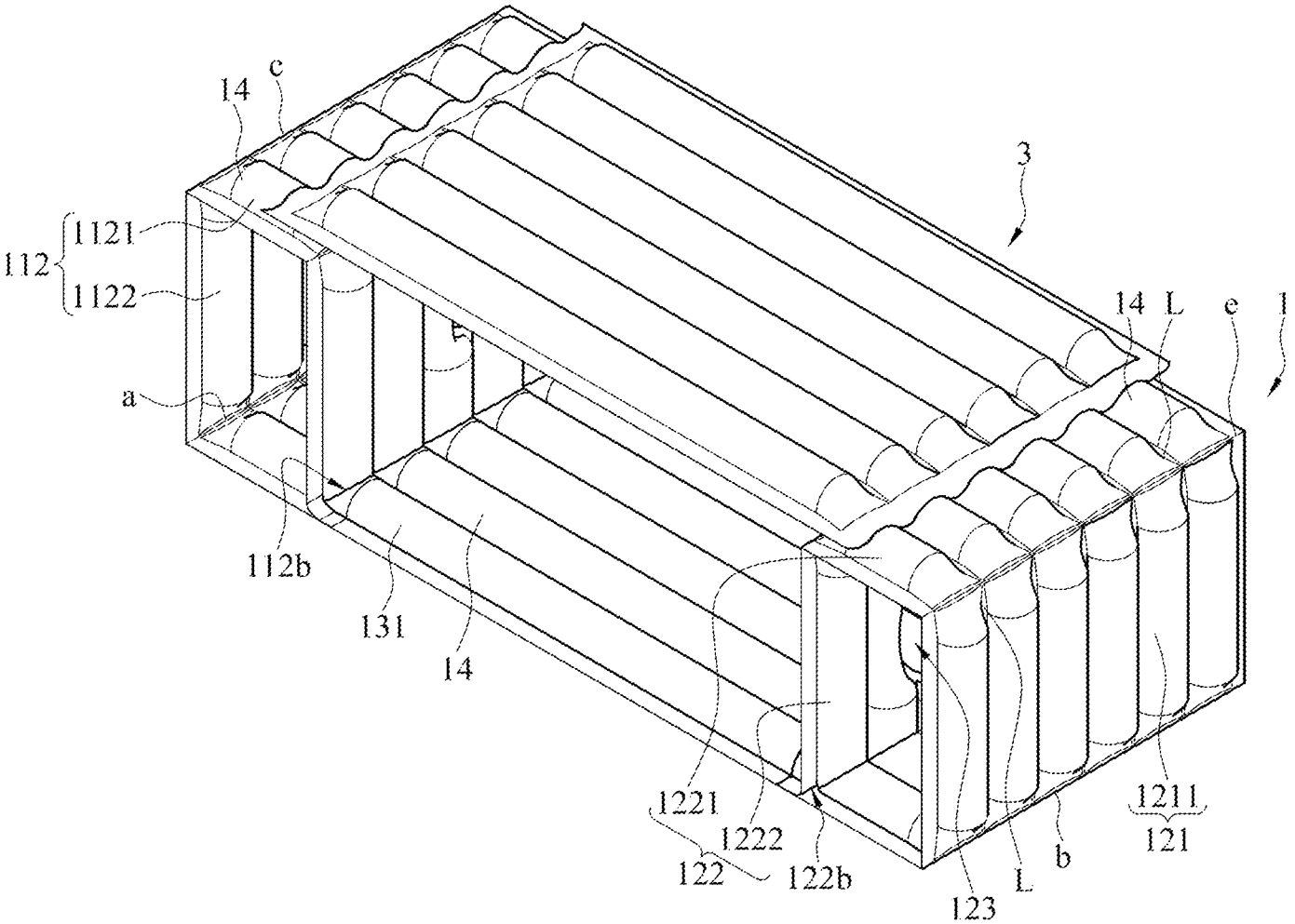
FIG. 7 is a schematic appearance diagram of an inflatable package wine bag according to a fourth embodiment of the present invention.

FIG. 7 is a schematic appearance diagram of an inflatable package wine bag 1 according to a fourth embodiment of the present invention. In this embodiment, the inflatable package wine bag 1 further includes a protective surface wall 3, located on one side of a bottom wall 13 and connected to a first fixing structure 11 and a second fixing structure 12. As shown in FIG. 7, the protective surface wall 3 may be disposed on a relative surface of the bottom wall 13 in a heat sealing manner and to strengthen the protection of the inflatable package wine bag 1.

The inflatable package wine bag disclosed by a plurality of or one embodiment of the invention has an easy packaging operation, low manufacturing cost, high protection strength, and high stability, which is sufficient to ensure the safety of conveying goods. In addition, in an embodiment, the inflatable package wine bag may be used not only for carton and container transportation, but also as a display base for collecting and transporting goods, which is effective.

What is claimed is:

1. An inflatable package wine bag, formed by a plurality of air columns, wherein each of the air columns comprises heat sealing lines on two sides of an extending direction, and the inflatable package wine bag further comprises:

a bottom wall;

a first fixing structure, comprising a first connecting portion and a first bending portion, wherein one end of the first connecting portion is connected to a top end of the bottom wall, a first heat sealing pitch line is disposed at a joint between the first connecting portion and the bottom wall, the other end of the first connecting portion is connected to a first connecting end of the first bending portion, and a first extending end opposite to the first connecting end in the first bending portion is adhered to an upper surface of the bottom wall, a plurality of first heat sealing contacts is disposed on the heat sealing lines on the first extending end, and is adhered to the heat sealing lines relatively adjacent to the top end, and the first bending portion comprises a first inner side surface wall and a first opening, and the first opening is disposed on the first inner side surface wall; and a second fixing structure, comprising a second connecting portion and a second bending portion, one end of the second connecting portion is connected to a bottom end of the bottom wall, and a second heat sealing pitch line is disposed at a joint between the second connecting portion and the bottom wall, the other end of the second connecting portion is connected to a second connecting end of the second bending portion, and a second extending end opposite to the second connecting end in the second bending portion is adhered to the upper surface of the bottom wall, a plurality of second heat sealing contacts is disposed on the heat sealing lines on the second extending end, and is adhered to the heat sealing lines relatively adjacent to the bottom end, and the second bending portion comprises a second inner side surface wall and a second opening, and the second opening is disposed on the second inner side surface wall.

2. The inflatable package wine bag according to claim 1, wherein the first connecting portion is a first outer side surface wall, the first bending portion further comprises a first connecting surface wall, the first connecting surface wall is connected to the first outer side surface wall and the first inner side surface wall, and the first inner side surface wall is adhered to the bottom wall.

3. The inflatable package wine bag according to claim 2, wherein a first outer side heat sealing pitch line is disposed at a joint between the first connecting surface wall and the first outer side surface wall and a first inner side heat sealing pitch line is disposed at a joint between the first connecting surface wall and the first inner side surface wall.

4. The inflatable package wine bag according to claim 2, wherein a plane of the first inner side surface wall forms a first acute angle with a plane of the bottom wall.

5. The inflatable package wine bag according to claim 2, wherein a plane of the first inner side surface wall is perpendicular to a plane of the bottom wall.

6. The inflatable package wine bag according to claim 1, wherein the second connecting portion is a second outer side surface wall, the second bending portion further comprises a second connecting surface wall, the second connecting surface wall is connected to the second outer side surface wall and the second inner side surface wall, and the second inner side surface wall is adhered to the bottom wall.

7. The inflatable package wine bag according to claim 6, wherein a second outer side heat sealing pitch line is disposed at a joint between the second connecting surface wall and the second outer side surface wall and a second inner side heat sealing pitch line is disposed at a joint between the second connecting surface wall and the second inner side surface wall.

8. The inflatable package wine bag according to claim 6, wherein a plane of the second inner side surface wall forms a second acute angle with a plane of the bottom wall.

9. The inflatable package wine bag according to claim 6, wherein a plane of the second inner side surface wall is perpendicular to a plane of the bottom wall.

10. The inflatable package wine bag according to claim 1, further comprising a protective surface wall, located on one side of the bottom wall, and connected to the first fixing structure and the second fixing structure.

* * * * *